US006261644B1

(12) United States Patent
Nittel et al.

(10) Patent No.: US 6,261,644 B1
(45) Date of Patent: Jul. 17, 2001

(54) PROCESS FOR THE ELECTROLESS DEPOSITION OF COPPER COATINGS ON IRON AND IRON ALLOY SURFACES

(75) Inventors: Klaus-Dieter Nittel, Frankfurt am Main; Karl-Heinz Nuss, Neu-Isenburg, both of (DE)

(73) Assignee: Metallgesellschaft Aktiengesellschaft, Frankfurt am Main (DE)

( * ) Notice: Subject to any disclaimer, the term of this patent is extended or adjusted under 35 U.S.C. 154(b) by 854 days.

(21) Appl. No.: 08/554,288

(22) Filed: Nov. 6, 1995

(30) Foreign Application Priority Data

Nov. 11, 1994 (DE) ..... 44 40 299

(51) Int. Cl.[7] ..... B05D 1/18
(52) U.S. Cl. ..... 427/437; 427/443.1; 427/443.2
(58) Field of Search ..... 427/437, 443.1, 427/443.2

(56) References Cited

U.S. PATENT DOCUMENTS

| | | | | |
|---|---|---|---|---|
| 2,410,844 | | 11/1946 | Signaigo et al. | 117/130 |
| 3,460,953 | | 8/1969 | Schwartz | 106/1 |
| 3,535,129 | | 10/1970 | Oei et al. | 106/1 |
| 3,620,822 | | 11/1971 | Oei et al. | 117/130 R |
| 3,793,037 | | 2/1974 | Hacias | 106/1 |
| 4,297,397 | * | 10/1981 | Feldstein | 427/304 |
| 4,563,216 | * | 1/1986 | Knaster et al. | 106/1.23 |

FOREIGN PATENT DOCUMENTS

| | | | | |
|---|---|---|---|---|
| 714437 | * | 11/1941 | (DE) | 486/8 |
| 1621291 | | 2/1971 | (DE) | C23C/3/00 |
| 1621293 | | 8/1973 | (DE) | C23C/3/00 |
| 1257758 | * | 2/1961 | (FR) . | |
| 2175729 | | 10/1973 | (FR) | C23C/3/00 |

OTHER PUBLICATIONS

G. Barrow, Physical Chemistry, 1979 by McGrow–Hill, Inc, pp. D618–D627.*
CRC Handbook of Chemistry and Physics, 1982–1983 by CRC Press, pp. 162–167.*

* cited by examiner

*Primary Examiner*—Benjamin L. Utech
(74) *Attorney, Agent, or Firm*—Fulbright & Jaworski, LLP

(57) ABSTRACT

Disclosed is a process for the electroless deposition of a copper coating on an iron or iron alloy surface wherein the workpiece surface is contacted with a solution which contains hydrogen ions, 5 to 30 g/l Cu as well as 0.2 to 5 g/l Mg and preferably copper and magnesium with a weight ratio of Cu:Mg of (35 to 5):1 for a treatment time of 3 sec to 15 min at a temperature of the solution of 20 to 65° C.

5 Claims, No Drawings

PROCESS FOR THE ELECTROLESS DEPOSITION OF COPPER COATINGS ON IRON AND IRON ALLOY SURFACES

BACKGROUND OF THE INVENTION

The present invention relates to a process for the electroless deposition of copper coatings on iron and iron alloy surfaces by means of solutions containing copper and hydrogen ions, and to a solid concentrate for carrying out this process.

It is known to facilitate the cold forming of iron and iron alloys by applying a copper coating onto the workpiece to be formed. Such coatings can be generated in an electroless way in that the metal surface is brought in contact with an aqueous, acid solution containing copper ions. In order to achieve good and in particular adhesive coatings, numerous proposals have been made, which provide for the addition of a variety of modifiers.

In the process in accordance with the DE-C-714 437 copper plating solutions are being used, which in addition to copper, hydrogen, chloride, bromide and/or fluoride ions contain strong organic pickling inhibitors for delaying the dissolution of iron. Useful pickling inhibitors include for instance coal tar bases, the bases extracted from animal distillates, aldehyde amine reaction products, aldehyde ketone reaction products, numerous amino acids, alkaloids and the sulfonated derivatives thereof.

Furthermore, it is known to add polyhydroxy thiols (U.S. Pat. No. 2,410,844) and brightening agents or grain refining agents, such as condensation products of fatty alcohols, fatty acids, tall oil, alkyl phenols, fatty amines, substituted thioureas, each comprising ethylene oxide, as well as long-chain organic amines, reducing sugars, and decomposition products of sugar (FR-A-1,257,758) to electroless copper plating solutions.

It is also known to provide a treatment with an aqueous, acid solution containing copper ions, chloride ions and an organic modifier for the electroless production of copper coatings on iron and iron alloys, where acridine and/or acridine derivatives are used as an organic modifier (DE-B-16 21 291).

Finally, it is known to use solutions containing copper, hydrogen and fluoride ions for the electroless deposition of copper, for which solutions both the fluoride concentration and the hydrogen ion concentration are chosen within certain coordinates in dependence on the temperature (DE-B-16 21 293).

Despite the multitude of known processes for the electroless deposition of copper, problems repeatedly arise in practice, as one does not, or not with the required safety, succeed in producing copper coatings which are both bright and adhesive, cover uniformly, and have a good appearance. A further problem is that the solid concentrates normally used for making the copper plating solutions have a poor flowability and are thus difficult to handle.

It is the object of the invention to provide a process for the electroless deposition of copper coatings on iron and iron alloy surfaces, which does not have the known, in particular the aforementioned disadvantages, and is able to produce uniform and adhesive coatings.

THE INVENTION

The object is accomplished in that the process of the above-mentioned type is conducted in accordance with the invention such that the workpiece surface is brought in contact with a solution containing 5 to 30 g/1 Cu as well as 0.2 to 5 g/1 Mg.

In accordance with a preferred embodiment of the invention the surfaces are brought in contact with a solution wherein the weight ratio of Cu:Mg lies in the range of (35 to 5):1. A weight ratio in the aforementioned range leads to an optimum gloss of the produced coating.

In accordance with a further advantageous embodiment of the invention, the iron or iron alloy surface is brought in contact with a solution which additionally contains polyglycol and/or sodium chloride. The addition of polyglycol gives an improvement in the adherence of the coating, and the addition of sodium chloride provides a more uniform attack on the iron or iron alloy surface.

Furthermore, it is advantageous to contact the iron or iron alloy surface with the solution for a duration of 3 sec to 15 min. The solution should advantageously have a temperature of 20 to 65° C.

The invention also comprises a solid concentrate for preparing and replenishing the solution designed for carrying out the process, which consists of at least 85 wt-% CuSO4 $\cdot 5H_2O$ and $MgSO_4$ (anhydrous) with a weight ratio of (35 to 5):1 (calculated as Cu:Mg).

In accordance with a further advantageous embodiment the solid concentrate contains in addition a maximum of 10 wt-% polyglycol, and in accordance with a further advantageous embodiment a maximum of 5 wt-% sodium chloride.

Before the application of the copper plating solution, impurities, such as in particular rust and scale, are removed from the iron and iron alloy surfaces. The surface conditioning is performed by pickling in mineral acid, preferably by pickling in hydrochloric acid or sulfuric acid, followed by rinsing with water.

If the iron and iron alloy surfaces have additional impurities, it is advantageous to include a cleaning step before the pickling process.

The copper coatings produced by means of the inventive process have a considerable adherence and a strong gloss. A further advantage of this process is that the increase of iron in the copper plating solution is significantly retarded, so that a greater throughput of iron or iron alloy surface is possible without influencing the iron concentration in the solution.

The solid concentrate, which is likewise a subject-matter of the invention, exhibits a good flowability and can thus easily be handled even after a long storage period.

The invention is further explained by the following examples.

EXAMPLE 1

In a wire drawing plant steel wires were pickled with hydrochloric acid, rinsed in cold water and dipped into a solution that had been prepared with 27 g/l $CuSO_4 \cdot 5H_2O$
2.4 g/l $MgSO_4$ (anhydrous)
g/l $H_2SO_4$ (100%) as well as
0.6 g/l polyglycol.

The addition of copper sulfate, magnesium sulfate and polyglycol was effected by means of a premixed concentrate. The temperature of the solution was 40° C., and the dipping time was 10 minutes. The weight ratio of Cu:Mg was 14.2:1.

The effectiveness of the copper plating solution was maintained at the the aforementioned values by adding a solid concentrate, which contained 90 wt-% $CuSO_4 \cdot 5H_2O$, 8 wt-% $MgSO_4$ (anhydrous) and 2 wt-% polyglycol, and by the addition of sulfuric acid.

The steel wires treated in accordance with this process had a uniform, adhesive copper coating with a coating weight of 20 g/m$^2$.

The copper plating solution absorbed 18.5 g iron per m$^2$ of treated steel surface.

When in comparison to the above-mentioned process a copper plating solution was used which was free of magnesium, but otherwise had the same contents of copper sulfate and polyglycol and was applied in the same way, the dissolved iron quantity was 22 g/m$^2$. This means that without any measures for reducing the iron content, about 1.2 times the amount of steel wire could be provided with a copper coating without a deterioration in quality when using the process in accordance with the invention.

EXAMPLE 2

Steel wires were pickled with sulfuric acid, rinsed with cold water and by passing therethrough were brought in contact with a solution that had been prepared by dissolving 30 kg of solid concentrate consisting of 95 wt-% $CuSO_4 \cdot 5H_2O$, 4 wt-% $MgSO_4$ (anhydrous) and 1 wt-% NaCl, as well as 55 kg sulfuric acid (100%) in 1000 l water. The solution contained the following calculated as salt or acid content 28.5 g/l $CuSO_4 \cdot 5H_2O$,
1.2 g/l $MgSO_4$ (anhydrous),
0.3 g/l NaCl, as well as 55 g/l $H_2SO_4$ (100%)

The weight ratio of Cu:Mg was 30.2:1. The temperature of the solution was set at 60° C., the contact time was 30 sec.

By adding the aforementioned concentrate and sulfuric acid, the constituents of the solution were maintained at the aforementioned values. In this case as well, the steel wires had a uniform copper coating of very good adhesion and considerable gloss. The coating weight was 4 g/m$^2$. The copper plating solution absorbed 3.7 g iron per m$^2$. The copper plating solution absorbed 3.7 g iron per m$^2$ treated wire surface.

As compared to a solution that was free of magnesium, but otherwise had the same composition and had been applied in the same way, the amount of iron that had gone into solution was 4.4 g/m$^2$. Accordingly, the process in accordance with the invention provided for a wire throughput increased by about 20%, without a deterioration in the quality of the copper coatings obtained.

It will be understood that the specification and examples are illustrative but not limitative of the present invention and that other embodiments within the spirit and scope of the invention will suggest themselves to those skilled in the art.

What is claimed is:

1. A process for the electroless deposition of a copper coating on an iron or iron alloy surface by means of a solution containing copper and hydrogen ions, comprising: contacting the surface with a solution comprising 5 to 30 g/l Cu and 0.2 to 5 g/l Mg.

2. The process of claim 1 wherein the surface is contacted with a solution containing copper and magnesium in a weight ratio of Cu:Mg of (35 to 5):1.

3. The process of claim 1 wherein the surface is contacted with a solution further comprising polyglycol and/or sodium chloride.

4. The process of claim 1 wherein the surface is contacted with the solution for a period of 3 sec to 15 min.

5. The process of claim 1 wherein the surface is contacted with the solution which has a temperature of 20 to 65° C.

* * * * *